US006884030B2

(12) United States Patent
Darkins, Jr. et al.

(10) Patent No.: US 6,884,030 B2
(45) Date of Patent: Apr. 26, 2005

(54) METHODS AND APPARATUS FOR SECURING MULTI-PIECE NOZZLE ASSEMBLIES

(75) Inventors: Toby George Darkins, Jr., Loveland, OH (US); Daniel Gene Dunn, Guilderland, NY (US); Christopher Grace, Simpsonville, SC (US); Gregory Scot Corman, Ballston Lake, NY (US); Mark Stewart Schroder, Hendersonville, NC (US)

(73) Assignee: General Electric Company, Schenectady, NY (US)

( * ) Notice: Subject to any disclaimer, the term of this patent is extended or adjusted under 35 U.S.C. 154(b) by 76 days.

(21) Appl. No.: 10/325,085

(22) Filed: Dec. 20, 2002

(65) Prior Publication Data

US 2004/0120811 A1 Jun. 24, 2004

(51) Int. Cl.[7] ..... F01D 9/04

(52) U.S. Cl. ..... 415/191; 29/889.22; 415/200; 415/209.4

(58) Field of Search ..... 29/889.21, 889.22; 415/200, 191, 209.2, 209.3, 209.4, 210.1

(56) References Cited

U.S. PATENT DOCUMENTS

| | | | | | |
|---|---|---|---|---|---|
| 730,363 | A | * | 6/1903 | Geisenhöner | 29/889.21 |
| 2,925,998 | A | * | 2/1960 | Hayes | 29/889.22 |
| 5,511,940 | A | * | 4/1996 | Boyd | 415/200 |
| 6,000,906 | A | * | 12/1999 | Draskovich | 415/200 |
| 6,164,903 | A | * | 12/2000 | Kouris | 415/200 |
| 6,325,593 | B1 | | 12/2001 | Darkins, Jr. et al. | |
| 6,398,501 | B1 | | 6/2002 | Darkins, Jr. et al. | |

* cited by examiner

*Primary Examiner*—Edward K. Look
*Assistant Examiner*—Richard A. Edgar
(74) *Attorney, Agent, or Firm*—Armstrong Teasdale LLP

(57) ABSTRACT

A method for securing a nozzle for a turbine is provided. The nozzle includes an airfoil having a suction side and a pressure side connected at a leading edge and a trailing edge such that a cooling cavity is defined within the airfoil, the airfoil extending between an inner band and an outer band. The method includes extending at least one member through the airfoil, and at least one of the inner band and the outer band. The method further includes securing the nozzle assembly in position with at least one fastener such that the at least one member is coupled adjacent to at least one of the inner band and the outer band.

18 Claims, 5 Drawing Sheets

METHODS AND APPARATUS FOR SECURING MULTI-PIECE NOZZLE ASSEMBLIES

BACKGROUND OF THE INVENTION

This invention relates generally to turbine engine nozzles and more particularly, to methods and apparatus for securing multi-piece nozzle assemblies.

At least some known turbine engines include a turbine nozzle assembly which channels flow towards a turbine. At least some known turbine nozzle assemblies include a plurality of nozzles arranged circumferentially within the engine. Each nozzle includes an airfoil vane that extends between inner and outer band platforms. Each airfoil vane includes a pair of sidewalls that are connected at a leading edge and a trailing edge.

During operation, the nozzles are typically cooled by a combination of internal convective cooling and gas side film cooling. Typically, the metal temperature distribution of a vane airfoil is such that the trailing edge is significantly hotter than a temperature of the bulk of the airfoil. The temperature gradient created may induce compressive stresses at the vane trailing edge. The combination of such stresses and temperatures may result in the vane trailing edge being the life limiting location of the nozzle.

The overall efficiency of the gas turbine engine is directly related to the temperature of the combustion gases, and as such, engine efficiency may be limited by the ability to operate the turbine nozzle at high temperature. As such, cooling engine components, including the turbine components, is necessary to facilitate reducing thermal stresses induced to such components. Accordingly, at least some known turbine nozzles include cavity cooling circuits which define flow paths for channeling cooling air flow through the cavity for cooling the airfoil, prior to the air flow being discharged downstream through trailing edge slots defined within the airfoil. Because of material limitations, known nozzle airfoils may require a complex cooling scheme to reduce operating temperatures within the airfoil.

BRIEF SUMMARY OF THE INVENTION

In one aspect, a method for securing a turbine nozzle is provided. The nozzle includes an airfoil having a suction side and a pressure side connected at a leading edge and a trailing edge such that a cooling cavity is defined within the airfoil. The airfoil extends between an inner band and an outer band. The method includes extending at least one member through the airfoil, and at least one of the inner band and the outer band. The method further includes securing the nozzle assembly in position with at least one fastener such that the at least one member is coupled adjacent to at least one of the inner band and the outer band.

In another aspect of the invention, a nozzle assembly for a turbine engine is provided. The nozzle assembly includes a plurality of nozzles that each include an outer band, an inner band and an airfoil. The airfoil has a suction side and a pressure side connected at a leading edge and a trailing edge, such that a cooling cavity is defined within the airfoil. The leading and trailing edges of the airfoil extend between the inner and the outer band. A member extends through said cooling cavity of said airfoil, and at least one of said inner band and said outer band. The member is secured within the nozzle assembly with at least one fastener such that the member is coupled adjacent to at least one of the inner and outer band.

In a further aspect, a turbine including a nozzle assembly is provided. The nozzle assembly includes a plurality of nozzles wherein each nozzle includes an outer band, an inner band and an airfoil. The airfoil has a suction side and a pressure side connected at a leading edge and a trailing edge such that a cooling cavity is defined within the airfoil. The airfoil extends between the inner and the outer band. A member extends through said cooling cavity of said airfoil, and at least one of said inner band and said outer band. The member is secured within the nozzle assembly with at least one fastener such that the member is coupled adjacent to at least one of the inner and outer band.

DETAILED DESCRIPTION OF THE INVENTION

Figure 1:
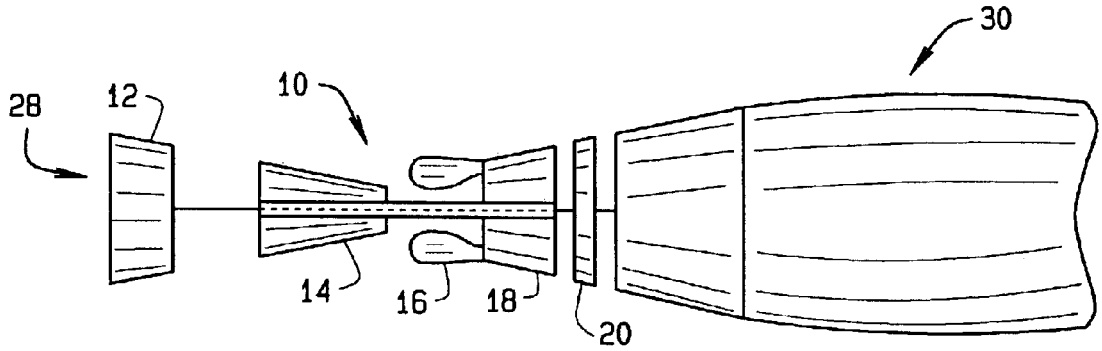
FIG. 1 is a schematic illustration of an exemplary turbine engine.

FIG. 1 is a schematic illustration of a gas turbine engine 10 including a low-pressure compressor 12, a high-pressure compressor 14, and a combustor 16. Engine 10 also includes a high-pressure turbine 18 and a low-pressure turbine 20. Engine 10 has an intake, or upstream, side 28 and an exhaust, or downstream, side 30. In one embodiment, engine 10 is a turbine engine commercially available from General Electric Power Systems, Schenechtady, N.Y.

In operation, air flows through low-pressure compressor 12 and compressed air is supplied to high-pressure compressor 14. The highly compressed air is delivered to combustor 16. Airflow from combustor 16 is discharged through a turbine nozzle assembly (not shown in FIG. 1) that includes a plurality of nozzles (not shown in FIG. 1) and used to drive turbines 18 and 20. Turbine 20, in turn, drives low-pressure compressor 12, and turbine 18 drives high-pressure compressor 14.

Figure 2:
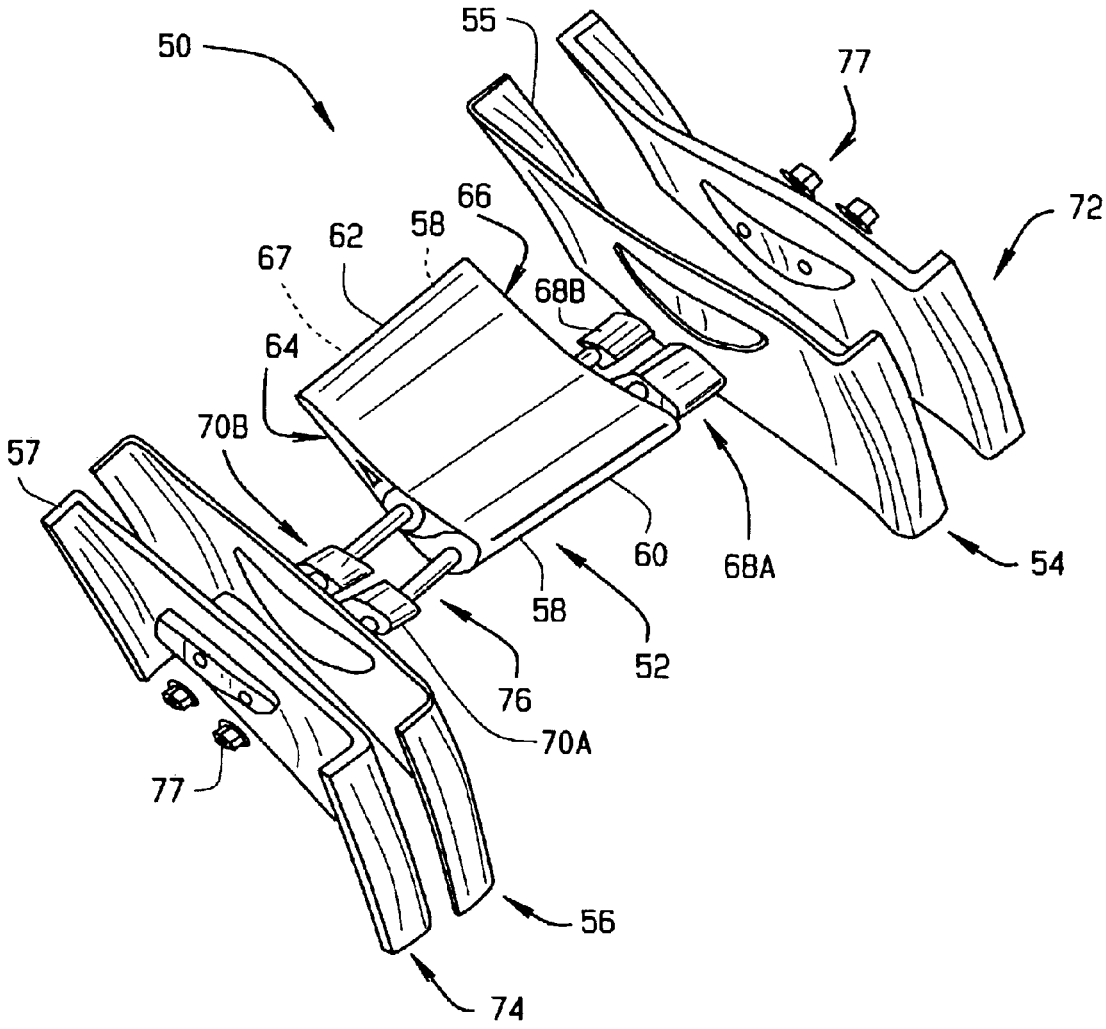
FIG. 2 is an exploded perspective view of a turbine nozzle assembly that may be used with the turbine engine shown in FIG. 1.

FIG. 2 is an exploded view of a turbine nozzle 50 that may be used with a turbine engine, such as engine 10 (shown in FIG. 1). Nozzle 50 includes an airfoil 52 that extends between a radially outer band 54 having an outer surface 55 and a radially inner band 56 having an outer surface 57. Each airfoil 52 includes a first sidewall 58 and a second sidewall 59. First sidewall 58 is convex and defines a suction side of airfoil 52, and second sidewall 59 is concave and defines a pressure side of airfoil 52. Sidewalls 58 and 59 are joined at a leading edge 60 and at an axially-spaced trailing edge 62 of airfoil 52.

First and second sidewalls 58 and 59, respectively, extend longitudinally, in span between radially inner band 56 and radially outer band 54. An airfoil root 64 is defined as being adjacent inner band 56, and an airfoil tip 66 is defined as being adjacent outer band 54. Additionally, first and second sidewalls 58 and 59, respectively, define a cooling cavity 67 within airfoil 52.

A first forward load transfer spacer 68A and a first aft load transfer spacer 68B are disposed within cooling cavity 67 and is adjacent airfoil tip 66. A second forward load transfer spacer 70A and a second aft load transfer spacer 70B are disposed within cooling cavity 67 and is adjacent airfoil root 64. In one embodiment, first forward load transfer spacer 68A and first aft load transfer spacer 68B form a single first load transfer spacer 68 and second forward load transfer spacer 70A and second aft load transfer spacer 70B form a single second load transfer spacer 70. A first assembly plate 72 is coupled against outer band outer surface 55 and a second assembly plate 74 is coupled against inner band outer surface 57. In another embodiment, first load spacer 68 and first assembly plate 72 are formed as one piece. In a further embodiment, second load spacer 70 and second assembly plate 74 are formed as one piece.

At least one member 76 extends through first assembly plate 72, outer band 54, first load spacer 68, airfoil 52, second load spacer 70, inner band 56, and second assembly plate 74. In one embodiment, a pair of members 76 extend through first assembly plate 72, outer band 54, first load spacer 68, airfoil 52, second load spacer 70, inner band 56, and second assembly plate 74. In the exemplary, members 76 are coupled in position using first and second load spacers 68 and 70 disposed within cooling cavity 67 and secured by fasteners, such as assembly nuts 77, at either first or second assembly plates 72 and 74.

Figure 3:
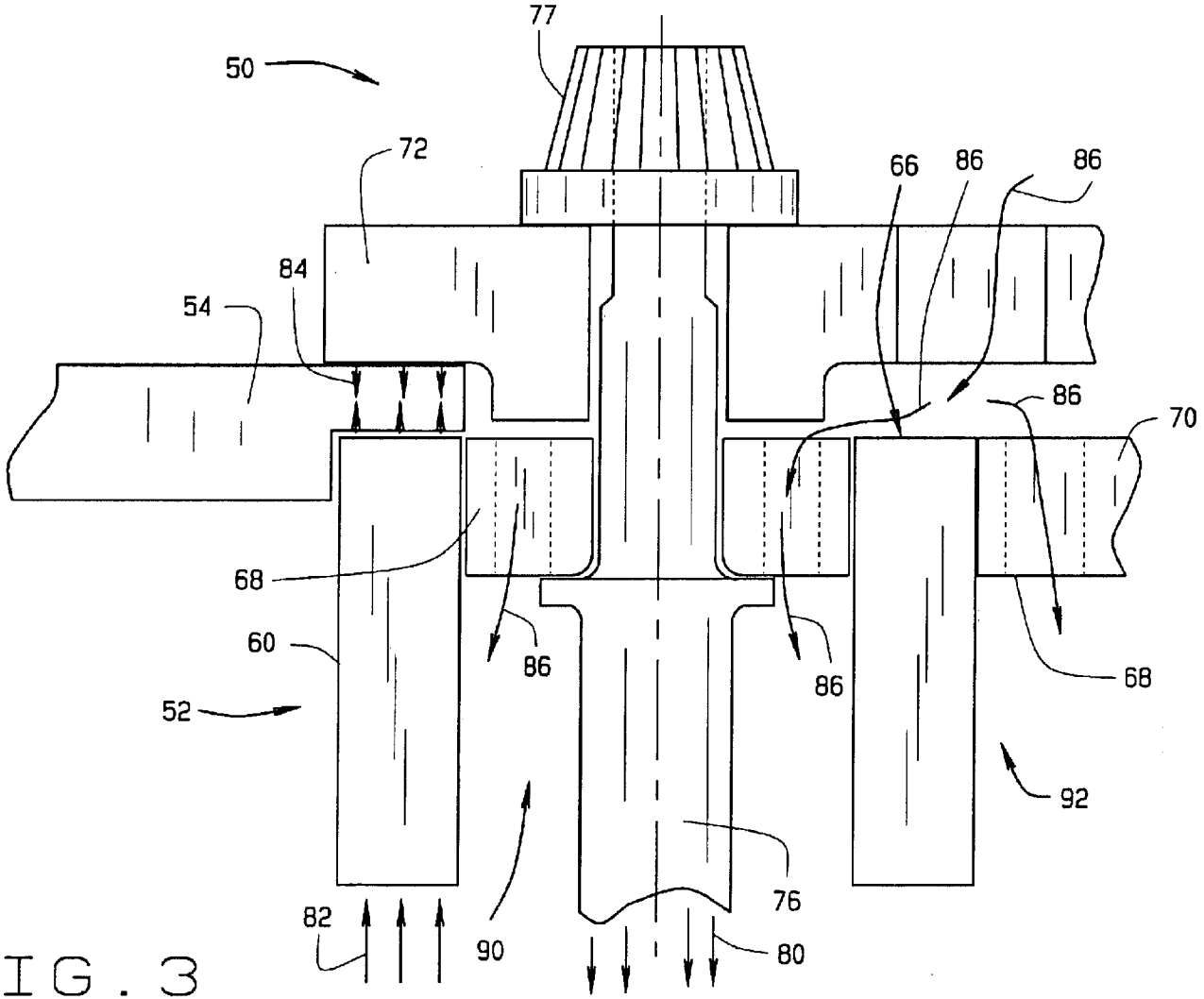
FIG. 3 is an enlarged schematic cross-sectional view of a portion of the turbine nozzle shown in FIG. 2.

FIG. 3 is an enlarged cross-sectional view of an assembled nozzle 50. Members 76 are secured in tension, illustrated by arrows 80, and airfoil 52 is secured in compression, illustrated by arrows 82, by assembly nuts 77 fastened to at least one of first and second assembly plates 72 and 74. When secured in position, members 76 facilitate sealing airfoil 52 between first assembly plate 72, outer band 54, inner band 56, and second assembly plate 74 with a clamping force illustrated by arrows 84. In one embodiment, members 76 have threaded ends to facilitate fastening assembly nuts 77 thereto. In another embodiment, at least one of first and second assembly plates 72 and 74 have a threaded opening sized to receive the end of member 76 allowing member 76 to extend substantially through at least one of first and second assembly plates 72 and 74.

In one embodiment, airfoil 52, and inner and outer segmented bands 54 and 56 are each formed of a material having a low strain to failure ratio, such as a ceramic material or ceramic matrix composite (CMC). In one embodiment, the CMC material is SiC—SiC CMC, a silicon infiltrated silicon carbide composite material reinforced with coated silicon carbide fibers. In one embodiment, ceramic material is a monolithic ceramic material such as SiC. More specifically, the material used in the fabricating of inner and outer bands 54 and 56 has a low thermal gradient capability, due to low strain to failure capability inherent to ceramics. In another embodiment, inner and outer segmented bands 54 and 56 are each formed of a low ductility material having a low tensile ductility.

First assembly plate 72 has an opening that permits air, illustrated by arrows 86 to enter nozzle 50. First load transfer spacer 68 is adjacent airfoil tip 66 and is substantially positioned within a first cooling cavity 90 and a second load transfer spacer 70 is substantially positioned within a second cooling cavity 92 to provide a means for member 76 to secure airfoil 52 to nozzle 50. In one embodiment, at least one of first load transfer spacers 68 and 70 have at least one opening allowing air 86 to enter first and second cooling cavities 90 and 92 of airfoil 52.

Figure 4:
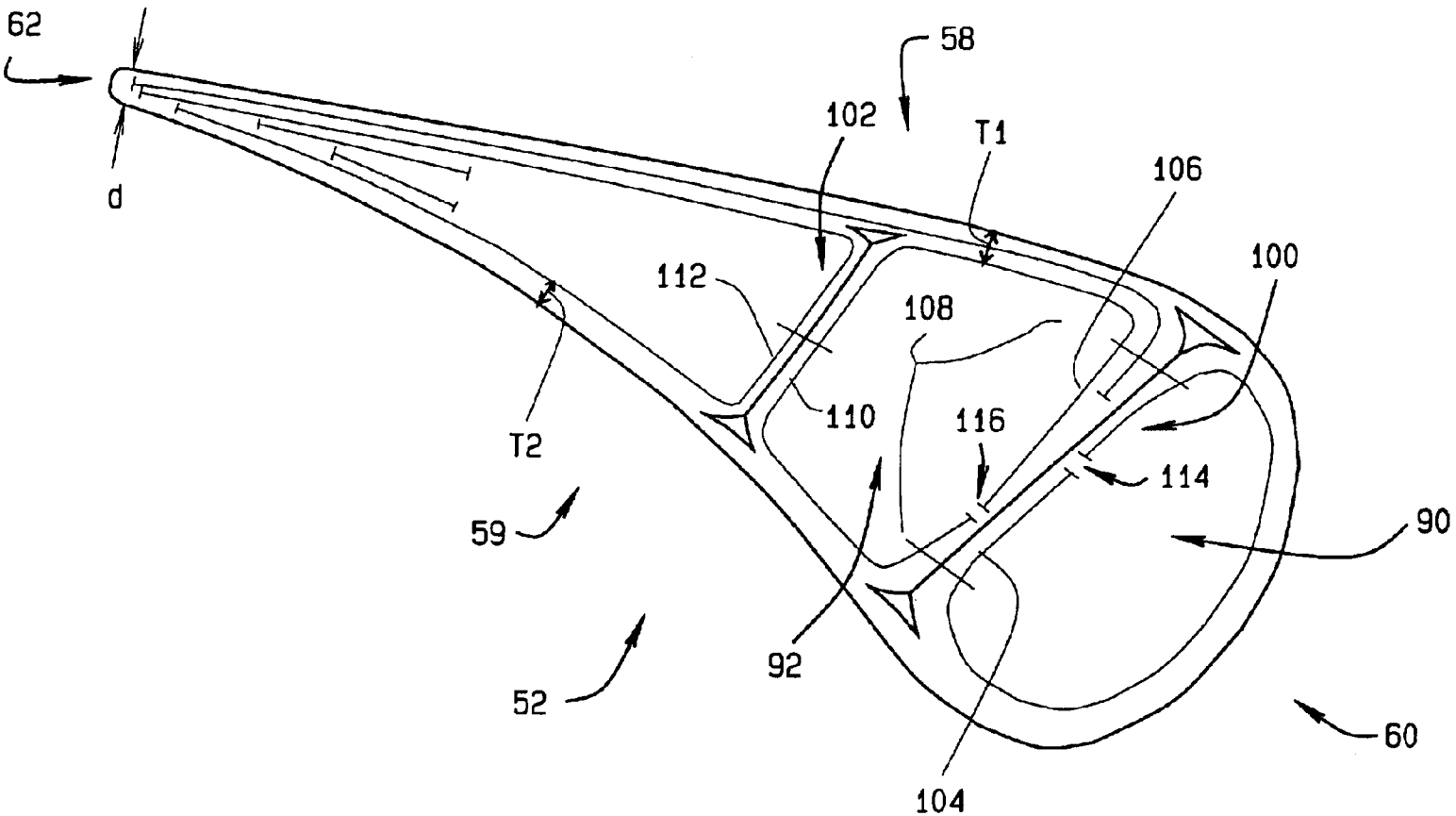
FIG. 4 is a cross-sectional view of an airfoil that may be used with the turbine nozzle assembly shown in FIG. 2.

FIG. 4 is a cross sectional view of airfoil 52, airfoil includes a first spar 100 and a second spar 102 that is positioned between first spar 100 and trailing edge 62. First spar 100 has a first side 104 and a second side 106 extending along a length 108. First cooling cavity 90 is formed between leading edge 60 and first spar first side 104. Second spar 102 has a first side 110 and a second side 112. Second cooling cavity 92 is formed between first spar second side 106, and second spar first side 110. In the exemplary embodiment, airfoil 52 is formed having plys of CMC. As shown in FIG. 4, ply splices are staggered in first spar 100, such that, a splice 114 in first spar first side 104 is offset from a splice 116 in first spar second side 106. Splices 114 and 116 are typically not positioned in high stress areas such as fillets.

In one embodiment, first and second sidewalls 58 and 59 have a variable thickness. First sidewall 58 has a thickness T1 that is greater than a thickness T2 of second sidewall 59 to accommodate a first pressure drop across the suction side that is greater than a second pressure drop across the pressure side. In one example, thickness T1 is approximately 0.15 inches and thickness T2 is approximately 0.1 inches. In another embodiment, first spar 100 has a varying thickness along length 108 of first spar 100.

Figure 5:
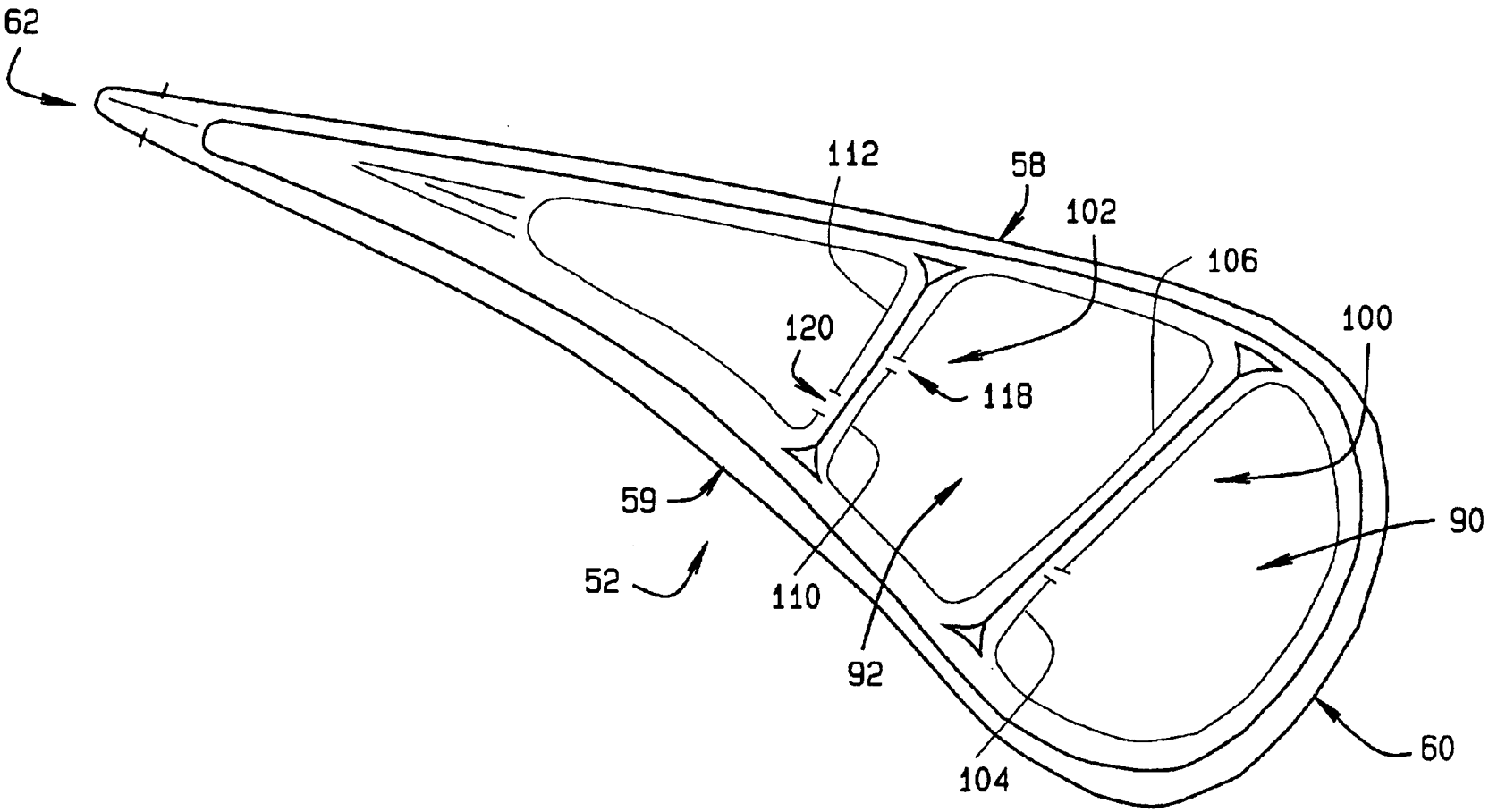
FIG. 5 is a cross-sectional view of an airfoil that may be used with the turbine nozzle assembly shown in FIG. 2.

FIG. 5 is a cross sectional view of another embodiment of airfoil 52. First and second sidewalls 58 and 59 have a constant thickness. In addition, ply splices are staggered in second spar 102 such that a splice 118 in second spar first side 110 is offset from another splice 120 in second spar second side 112.

The above-described nozzle assembly is a cost-effective and efficient device. The nozzle assembly includes a member that facilitates securing an airfoil to the inner and outer bands, thus reducing an amount of time necessary to remove and replace a nozzle assembly. Furthermore, the member is more easily removably coupled to the nozzle assembly than other known nozzle mounting methods. As a result, the member facilitates extending a useful life of the nozzle assembly in a cost-effective and efficient manner by providing repairability or replacement of sub-components that may exhibit distress.

Exemplary embodiments of nozzle assemblies are described above in detail. The systems are not limited to the specific embodiments described herein, but rather, components of each assembly may be utilized independently and separately from other components described herein. Each nozzle assembly component can also be used in combination with other nozzle assemblies and turbine components.

While the invention has been described in terms of various specific embodiments, those skilled in the art will recognize that the invention can be practiced with modification within the spirit and scope of the claims.

What is claimed is:

1. A method for securing a nozzle assembly within a turbine engine, the nozzle assembly including at least one nozzle, the nozzle having an airfoil including a suction side and a pressure side connected at a leading edge and a trailing edge such that a cooling cavity is defined within the airfoil, the airfoil extending between an inner band and an outer band, said method comprising:

extending at least one member through at least one of a plurality of cooling chambers defined within the cooling cavity of the airfoil, and at least one of the inner band and the outer band; and securing the nozzle assembly in position with at least one fastener such that the at least one member is coupled adjacent to at least one of the inner band and the outer band.

2. A method in accordance with claim 1 wherein at least one of the inner band, the airfoil, and the outer band is fabricated from at least one of a ceramic matrix composite material, and a monolithic ceramic material.

3. A method in accordance with claim 1 wherein securing the nozzle assembly in position induces tension in the member.

4. A method in accordance with claim 1 wherein extending at least one member further comprises extending a pair of members through the airfoil, and at least one of the inner band and the outer band.

5. A method in accordance with claim 1 further comprising:

positioning at least one load spacer within the cooling cavity; and extending the at least one member through the at least one load spacer to secure the airfoil to the at least one of the inner and the outer band.

6. A method in accordance with claim 5 extending the at least one member through the at least one load spacer further comprises sealing the airfoil between the at least one of the inner and the outer band.

7. A nozzle assembly for a turbine engine, said nozzle assembly comprising:

an outer band;

an inner band;

an airfoil having a suction side and a pressure side connected at a leading edge and a trailing edge such that a cooling cavity is defined within the airfoil, said leading and trailing edge of said airfoil extending between said inner band and said outer band, said airfoil further comprising at least one spar extending between said pressure and suction sides for dividing said cooling cavity into at least two cooling chambers; and a member extending through said cooling cavity of said airfoil, and at least one of said inner band and said outer band, said member secured within said nozzle assembly with at least one fastener such that said member is coupled adjacent to at least one of said inner and outer band.

8. A nozzle in accordance with claim 7 wherein at least one of the said inner band, said airfoil, and said outer band is fabricated from at least one of a ceramic matrix composite material, and a monolithic ceramic material.

9. A turbine nozzle in accordance with claim 7 wherein at least one fastener coupled to said member induces tension is said member.

10. A turbine nozzle in accordance with claim 7 wherein said member comprises a pair of members.

11. A nozzle in accordance with claim 7 further comprising at least one load spacer positioned within said cooling cavity, said member extending through said at least one load spacer to secure said airfoil to said at least one of said inner and said outer band.

12. A nozzle in accordance with claim 11 wherein said member seals said airfoil between said at least one of said inner and said outer band.

13. A turbine comprising:

a nozzle assembly having a plurality of nozzles, each nozzle comprising:

an outer band;

an inner band; and an airfoil having a suction side and a pressure side connected at a leading edge and a trailing edge such that a cooling cavity is defined within the airfoil, said leading and trailing edge of said airfoil extending between said inner band and said outer band, said airfoil further comprising at least one spar extending between said pressure and suction sides for dividing said cooling cavity into at least two cooling chambers; and a member extending through said cooling cavity of said airfoil, and at least one of said inner band and said outer band, said member secured within said nozzle assembly with at least one fastener such that said member is coupled adjacent to at least one of said inner and outer band.

14. A nozzle in accordance with claim 13 wherein at least one of the said inner band, said airfoil, and said outer band is fabricated from at least one of a ceramic matrix composite material, and a monolithic ceramic material.

15. A turbine nozzle in accordance with claim 13 wherein at least one fastener coupled to said member induces tension is said member.

16. A turbine nozzle in accordance with claim 13 wherein said member comprises a pair of members.

17. A nozzle in accordance with claim 13 further comprising at least one load spacer positioned within said cooling cavity, said member extending through said at least one load spacer to secure said airfoil to said at least one of said inner and said outer band.

18. A nozzle in accordance with claim 17 wherein said member seals said airfoil between said at least one of said inner and said outer band.

* * * * *